US006715478B1

(12) United States Patent
Tanner

(10) Patent No.: US 6,715,478 B1
(45) Date of Patent: Apr. 6, 2004

(54) PITCHING MACHINE

(76) Inventor: Steven R. Tanner, 6703 E. 99th Ter., Kansas City, MO (US) 64134

( * ) Notice: Subject to any disclaimer, the term of this patent is extended or adjusted under 35 U.S.C. 154(b) by 0 days.

(21) Appl. No.: 10/334,613

(22) Filed: Dec. 31, 2002

(51) Int. Cl.[7] ..... F41B 11/14
(52) U.S. Cl. ..... 124/16; 124/21; 124/7
(58) Field of Search ..... 124/16, 17, 21, 124/31, 36, 78, 7

(56) References Cited

U.S. PATENT DOCUMENTS 3,734,075 A * 5/1973 Staples ..... 124/78
4,122,822 A * 10/1978 Scheiwiller ..... 124/54
4,345,577 A * 8/1982 Andersson ..... 124/16
4,391,264 A * 7/1983 Abraham et al. ..... 124/50
4,524,749 A 6/1985 Giovagnoli
4,615,325 A * 10/1986 Yamamura et al. ..... 124/7
5,121,735 A 6/1992 Hancock
5,649,523 A * 7/1997 Scott ..... 124/78
5,911,214 A * 6/1999 Andrews ..... 124/16
6,089,215 A * 7/2000 Morris et al. ..... 124/16

* cited by examiner

*Primary Examiner*—Kien T. Nguyen
(74) *Attorney, Agent, or Firm*—Chase Law Firm, L.C.

(57) ABSTRACT

A ball pitching machine utilizes a leaf spring coupled by linkage to a ball pitching arm. The flexion of the spring can be adjusted by varying the time of operation of a motor driven spring flexion assembly. Upon the selectable spring flexion being achieved, the user then energizes a ball pitching arm for rotation of the arm through a rest position, a ball pick up position and then to a ball release position. During arm rotation, the arm is first coupled to the spring by a linkage assembly such that further rotation of the arm causes the stored energy in the spring to be released to the arm at a position to effect the ball trajectory. The ball trajectory compensates for the various ball speeds so that the ball penetrates the batter's strike zone. This energy transfer accelerates rotation of the arm to a ball release position, the speed of the ball, as perceived by the batter, corresponding in part to the spring flexion and/or ball trajectory as selected by the user.

23 Claims, 5 Drawing Sheets

PITCHING MACHINE

BACKGROUND OF THE INVENTION

This invention pertains to a pitching machine and, more particularly, to a ball pitching machine for pitching a ball at different user-selectable trajectories and/or speeds.

Various forms of ball pitching machines are known in the prior art which are said to simulate the speed and trajectory of balls as if pitched by an actual person.

In order to more accurately simulate the action of a pitched ball it is desirable to utilize a machine having a pitching arm. One problem with past machines was the inability to effectively vary the speed of the pitched ball as hurled from the pitching arm as manual adjustment of the machine was required. Thus, it is desirable to have such a function so that a range of users can effectively utilize one machine.

In response thereto I have invented a pitching machine which utilizes an elongated spring powered pitching arm. My machine utilizes a leaf spring which can be selectively flexed according to the desired speed of the pitched ball. Once flexed the spring is then releasably coupled to the pitching arm during rotation of the arm from a rest position to a ball release position. Subsequent to ball pick up the energy of the selectively flexed spring is released to the pitching arm so as to urge the arm towards its ball release position for ball release at a different trajectory. Accordingly, the degree of flexion of the spring controls in part the speed of the arm in rotatable movement to the ball release position and thus the speed and trajectory of the ball hurled therefrom.

Accordingly, it is a primary object of my invention to provide a pitching machine capable of simulating a pitched ball.

Another object of this invention is to provide a pitching machine, as aforesaid, wherein the speed of the pitched ball can be regulated.

Still another object of this invention is to provide a pitching machine, as aforesaid, which regulate the energy stored in a flexed spring for regulating the ball speed.

A further object of this invention is to provide a pitching machine, as aforesaid, wherein the degree of initial spring flexion is selectable by a user.

A still further object of this invention is to provide a pitching machine, as aforesaid, wherein the pitching arm is coupled to the flexed spring during movement from a ball rest to a ball release position for further spring flexion.

A particular object of this invention is to provide a pitching machine, as aforesaid, wherein a plurality of balls can be delivered for sequential pick up by the ball pitching arm.

A more particular object of this invention is to provide a pitching machine, as aforesaid, wherein the initial leaf spring flexion is provided by a motor driven chain drive assembly, which is regulated by a user.

Another particular object of this invention is to provide a pitching machine, as aforesaid, wherein the leaf spring is initially flexed by a first spring flexing assembly and then further flexed by rotation of the pitching arm.

A further particular object of this invention is to provide a pitching machine, as aforesaid, wherein the trajectory of the pitched ball can be regulated so as to deliver the ball at different speeds to the batter in the strike zone.

Other objects and advantages of this invention will become apparent from the following description taken in connection with the accompanying drawings, wherein is set forth by way of illustration and example, a now preferred embodiment of this invention.

DESCRIPTION OF THE PREFERRED EMBODIMENT

Figure 1:
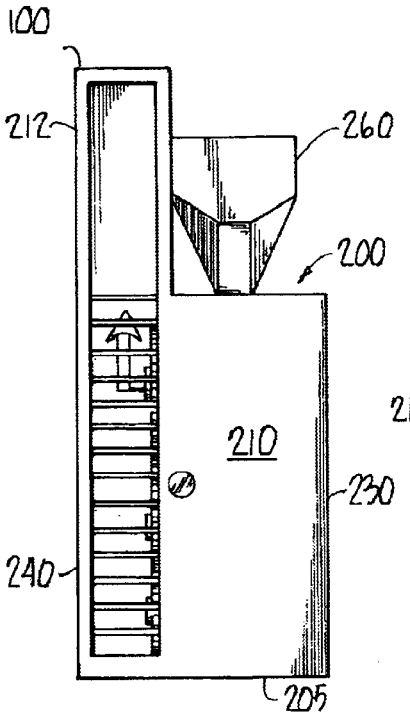
FIG. 1 is a front view of the pitching machine housing.
Figure 3:
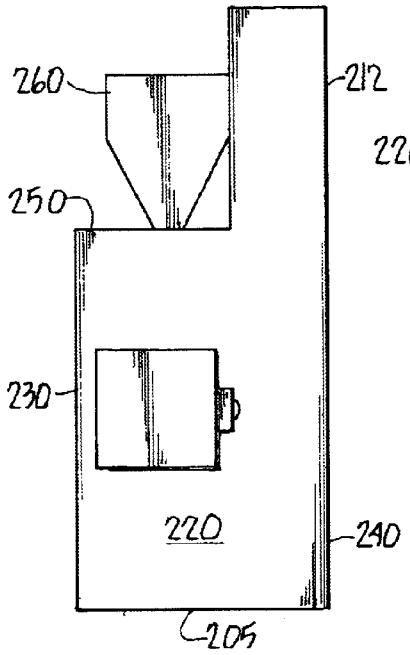
FIG. 3 is a rear view of the FIG. 1 pitching machine housing.

Turning more particularly to the drawings, FIGS. 1 and 3 show my pitching machine 100 encompassed by a housing 200. Housing 200 has a base 205, front 210, rear 220, side 230, 240 and top 250 walls. Walls have been broken away in the drawings for ease of illustration. The front wall 210 presents a vertical extension 212 allowing for rotation of pitching arm 550. A ball hopper 260 communicates with an opening in the top wall 250 for delivery of the balls via trough 262 to a ball rest 264.

Within the housing 200 is enclosed the pitching apparatus as supported by frame work including horizontal 270, 272, 274, 276, 278 and vertical 280, 282 struts. The pitching apparatus generally comprises a rotatable pitching arm assembly 500, a spring tension assembly 400 and an assembly for linking the tension of spring 410 to pitching arm 550.

The spring tension assembly 400 includes a multi-leaf spring 410 which is mounted at an intermediate point to bracket 414 which in turn is mounted to vertical strut 282. As such a lower spring end 412 and an upper spring end 416 is presented which are flexed relative to this intermediate mounting bracket 414.

The lower end 412 of spring 410 is connected to a linkage arm 420 which is pivotally linked to arm 422. Arm 422 is connected to a shaft 424 which extends through vertical frame strut 282. This shaft 424 is driveably connected to a cogged wheel 478 such that rotation of wheel 478 causes rotation of shaft 424 and rotation of linkage arms 420, 422 linked thereto.

The upper spring end 416 is linked to a cogged wheel 474 via intermediate linkage comprising arms 440, 442, 444, connecting rod 446 and linkage arm 448. One end of arm 444 is pivotally connected to frame strut 280 at 445 with the other end pivotally connected to arm 442 at 443. Arm 442 is in turn pivotally connected to arm 440 which is connected to a shaft 460 which extends through vertical strut 282 and is connected to wheel 474.

Figure 4:
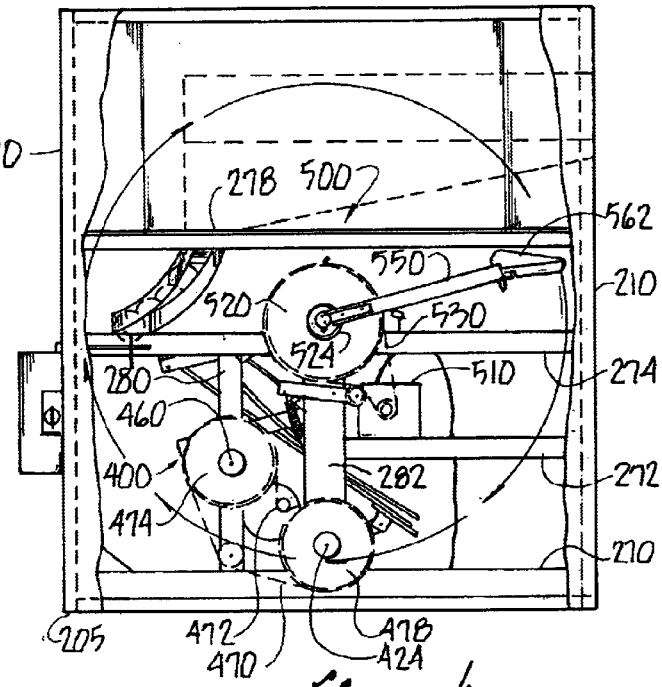
FIG. 4 is a right side view of the pitching machine with the right side wall broken away to show the apparatus therein in a rest position with the arrows indicating the rotatable path of the pitching arm.

As shown in FIG. 4 the spring tension assembly 400 further includes a chain 470 driven by an electric motor 472 shaft and wound about the cogged wheels 474, 478 and idler wheels. Energization of motor 472 results in a chain driven rotation of wheels 474, 478, associated shafts 424, 460 and linkage arms 420, 422, 440, 442. Rotation of these linkage arms imparts clockwise flexion to the lower spring end 412 and counterclockwise flexion of the upper end 416 of leaf spring via the linkage arm 444, rod 446, arm 448 combination as viewed in FIGS. 2, 5, 6 and 7.

Figure 5:
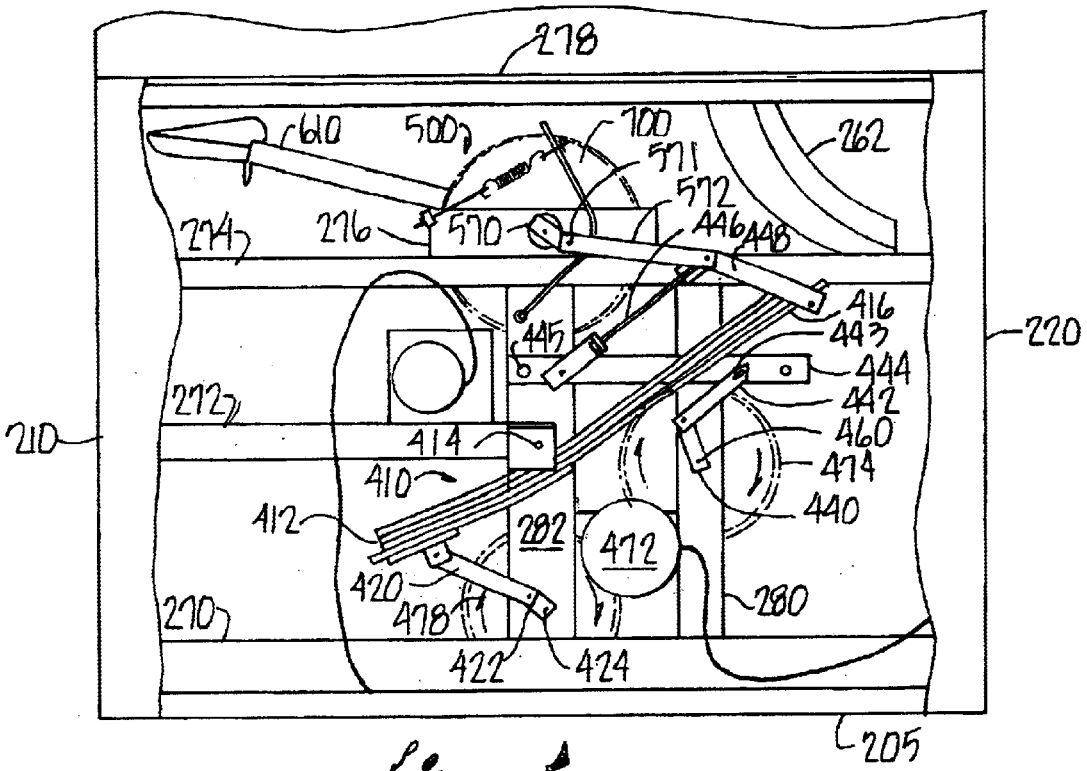
FIG. 5 is a left side view of the pitching machine showing the spring apparatus at an initial second flexion position beyond the FIG. 2 position.

As shown in FIG. 4 the pitching arm drive assembly 500 includes a motor 510, chain 530 driven wheel 520 and idler wheels. Wheel 520 is rotatably mounted about a shaft 522 extending through a frame strut 276 atop strut 282 (FIG. 5). Wheel 520 presents a central hub 524 having a lug/hub stop 526 thereon. One end 552 of the pitching arm 550 is attached to a sleeve 553 which rotatably encompasses the shaft 522. Thus, arm 550 can be independently rotated about shaft 522. The end 552 of pitching arm 560 presents a bracket 556 which is rotatable with arm 550.

Figure 8:
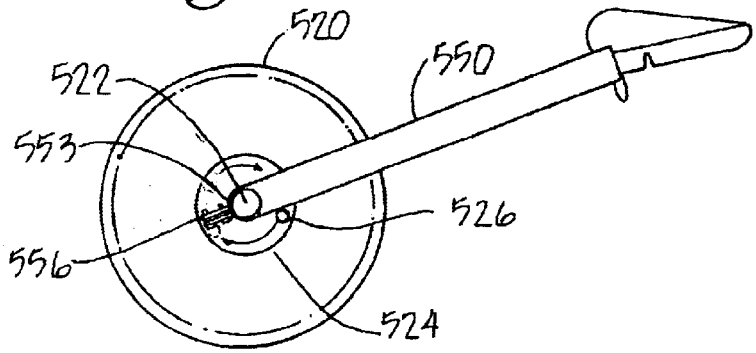
FIG. 8 is a diagrammatic view showing the position of the pitching arm wheel and arm at a rest position with the hub stop on the pitching arm drive wheel displaced from the pitching arm bracket.
Figure 9:
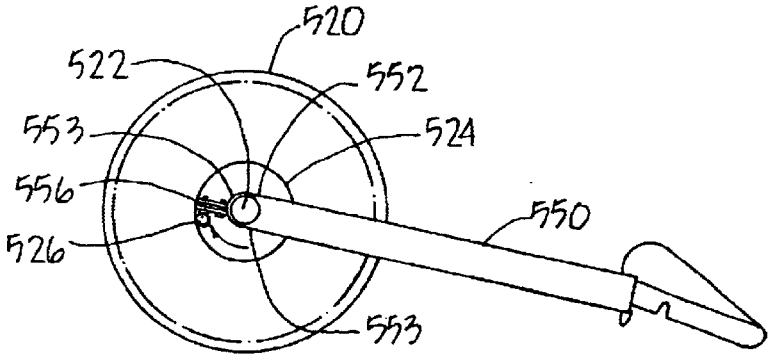
FIG. 9 is a diagrammatic view showing a subsequent contact of the hub stop of the pitching arm wheel with the pitching arm bracket upon clockwise rotation of the pitching arm wheel.

As diagrammatically shown in FIGS. 8–11, the energization of electric motor 510 rotates wheel 520 via drive chain 530. Pitching arm 550 will not rotate about shaft 522 until hub stop 526 contacts bracket 556 as shown in FIG. 9. At this point further rotation of wheel 520 will also rotate pitching arm 550 from a FIG. 9 position to a FIG. 10 ball pick up position and then to a FIG. 11 phantom line over center position due to the hub stop 526/bracket 556 contact.

Figure 12:
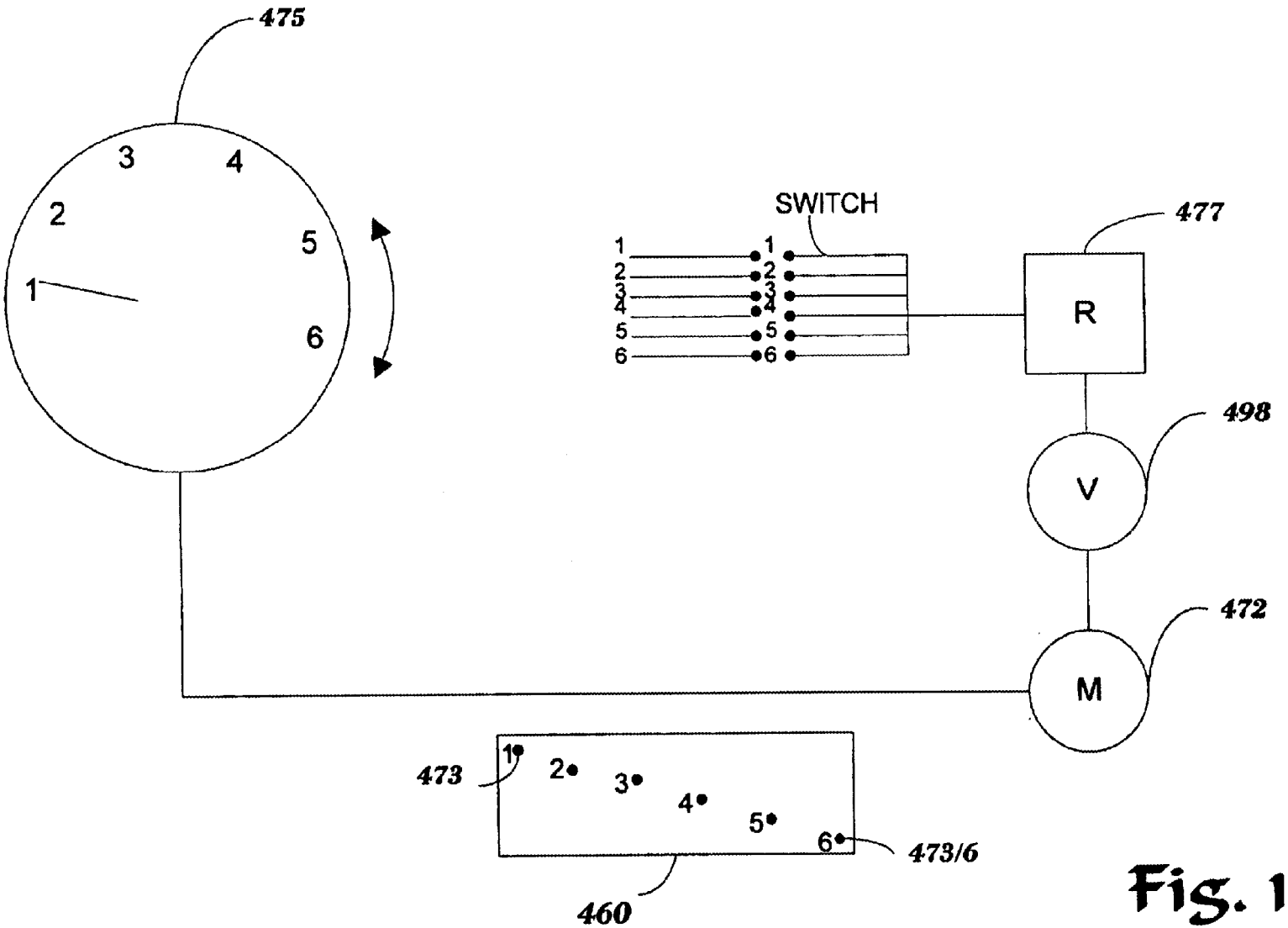
FIG. 12 diagrammatically shows one form of a spring flexion motor/switch/circuit combination.

A plurality of normally closed switches 1–6 or equivalents in an electrical circuit is diagrammatically shown in FIG. 12 as adjacent to motor 472 shaft 471. Such switches are mounted on frame adjacent motor 472 shaft 471. The user has a displaced rotary switch in series with these six parallel switches. These switches are part of an electrical circuit including rotary switch 475 at the selected position, relay 477, power source 498 and motor 472. Each switch is normally closed. Upon user selection of a particular position 1–6 of the rotary switch 475 the circuit energizes motor 472 and rotates the shaft 471. Lobes 473. on the adjacent rotating motor 472 shaft 471 will upon contact urge the related closed switch into an open position so as to open the particular circuit. The lobes 473 are arranged about the circumference of motor 472 shaft 471 such that lobes 1–6 correspond in a one-to-one relationship with switches 1–6. Lobe 473/1 will first contact an adjacent switch 1. Lobes 2–6 will subsequently contact adjacent switches 2–6. The lobes are thus arranged about the motor shaft 471 such that rotary switch position I will energize the motor 472 for the least amount of time with rotary switch position 6, energizing the motor for the maximum amount of time. Selection of rotary switch positions 2–5 will thus energize the motor 472 for successively longer increments relative to switch 1. Thus, the motor 472 operates the least amount of time if rotary switch position 1 is selected and the longest amount of time if rotary switch position 6 is selected.

Although I proposed a circuit for mechanical opening of the switches by a related lug 473 on the rotating motor 472 shaft, other equivalent switching circuitry may be used so as to energize the motor 472 for selected periods of time. Motor 570 is also subsequently energized by a user. However, this motor 570, once energized by a user, will operate for a set period of time.

Figure 2:
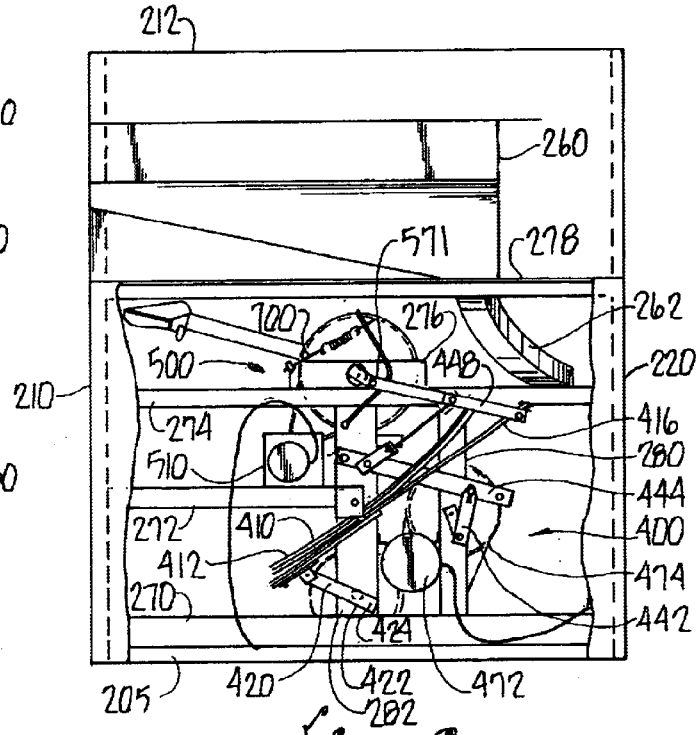
FIG. 2 is a left side view of the pitching machine with a wall of the housing broken away to show the apparatus therein at a rest position.

In use FIGS. 2 and 4 illustrate the pitching machine apparatus at its rest/relaxed position. At this position the pitching arm 550 is at approximately a ten o'clock position (FIG. 2) with the ends 412, 416 of leaf spring 410 being at a normal position. Upon selection of a rotary switch position (1–6) the energized motor 472 chain drives wheels 474, 478. Thus, the associated linkage arms, as above described, are variably rotated upon rotation of the associated wheels 474, 478. This linkage arm rotation causes arm 420 to upwardly urge the lower end 412 of the leaf spring from a rest position and into a flexed position relative to the rest position (clockwise as viewed in FIGS. 2 and 5). Concurrently, the linkage arms 440, 422 are likewise being rotated about shaft 460 by rotation of the wheel 474. This movement flexes the upper end 416 of the leaf spring 410 about its intermediate mounting point 414 (counterclockwise as viewed in FIGS. 2 and 5) via the intermediate linkage arms 444, 446, 448. Note in FIG. 5 that the displaced leaf of the spring 410 at the upper end (FIG. 2) is now contiguous to the adjacent leaf in FIG. 5 while the lower end 412 of the spring has been moved clockwise from its FIG. 2 position.

Accordingly, leaf spring 410 is now flexed which increases the potential energy stored therein. As the selectable rotary switch positions 1–6 varies the amount of time of motor 472 operation, the amount of movement of the linkage arms and thus flexion of the associated lower and upper ends of the leaf spring 410 can be controlled from a minimum flexion (switch 1) to a maximum flexion (switch 6). Thus, FIG. 5 shows the spring being at one user selectable flexed position which can be chosen from a plurality of six possible flexed positions. Thus, the degree of flexion of the spring 410 depends on the rotary switch position (1–6) selected corresponding to the time of motor 472 operation. This stored energy of the flexed spring 410 can now be transferred to the pitching arm 550.

Figure 6:
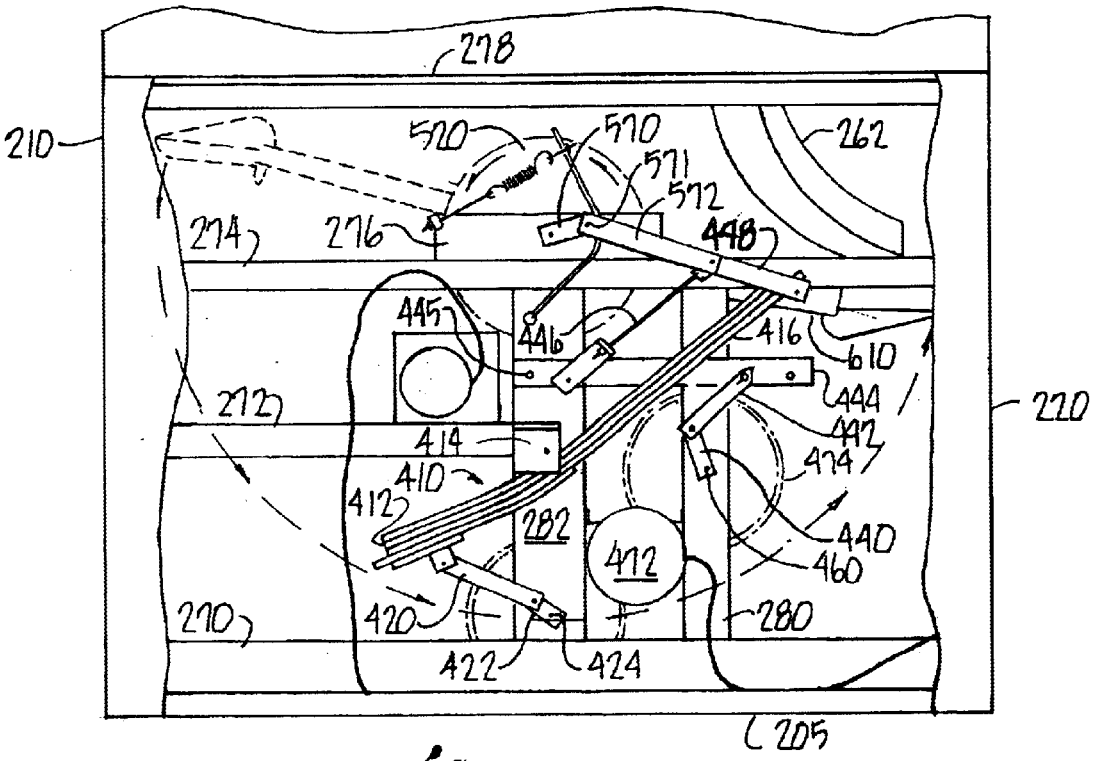
FIG. 6 is a left side view of the pitching machine as shown in FIG. 5 showing the spring apparatus beyond said second FIG. 5 flexion position as provided by rotation of the wheel and coupled pitching arm from the phantom line rest position to the solid line ball pick up position.
Figure 7:
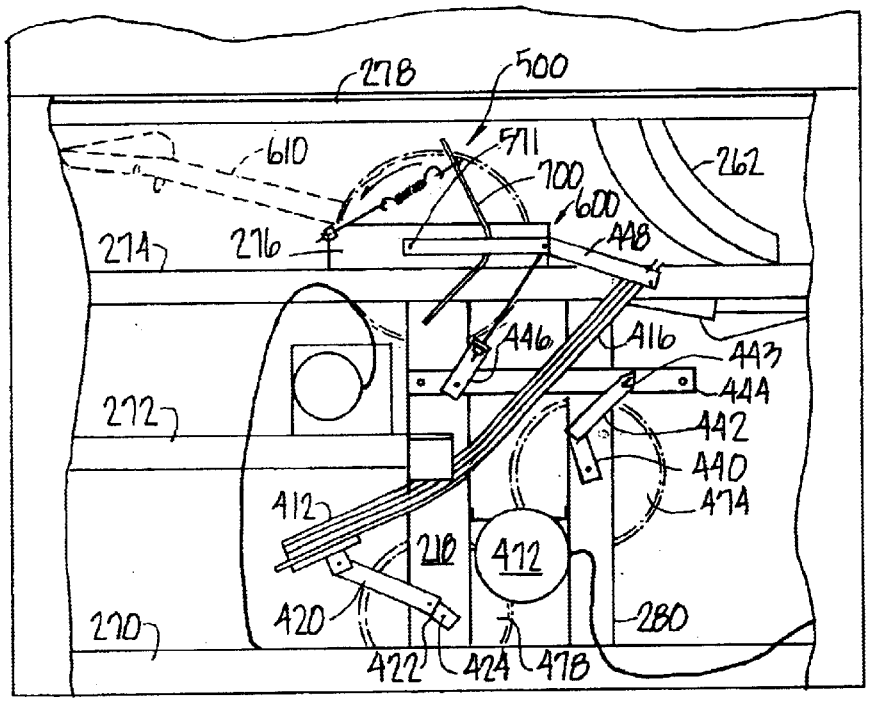
FIG. 7 is a left side view of the ball pitching machine in FIG. 6 showing a further flexion of the leaf spring in FIG. 6 as provided by further rotation of the pitching arm wheel and pitching arm.

Subsequent to spring 410 flexion, the pitching arm 550 is rotated by user closure of a circuit which energizes motor 510. Initially drive wheel 520 rotates independent of pitching arm 550 as hub stop 526 is free of bracket 553. During rotation of wheel 520 the lug/stop 526 on the hub 524 contacts pitching arm bracket 553 as shown in FIG. 9. At this position the further rotation of wheel 520 also rotates bracket 553 and arm 550 due to this stop 526/bracket 553 contact. At this FIG. 9 position, rotation of the arm 550 likewise rotates the linkage 570 arm connected to sleeve 553 and arm 572 pivotally connected to arm 570. Movement of these linkage arms 570, 572 is transferred to connected arm 448 which is connected to spring 416 end. Thus, the hub stop 526 contact moves the linkage arms 570, 572, 448 which further flexes the upper end 416 of spring 410 from the earlier flexed position. Note that FIGS. 6 and 7 show further successively greater flexion due to the rotation of the pitching arm 550 as coupled to the spring by these linkage arms.

Linkage arm 570 is pivotally connected to linkage arm 572 at pivot point 571. The height of this pivot point 571 relative to the base 205 is ultimately controlled by rotation of wheel 474. Thus, at switch position I the motor operation is the shortest such that pivot point 571 position is at its lowest. Switch position 6 places the pivot point 571 at the greatest height as motor 472 operates for the longest period. This pivot point 571 will have positions therebetween corresponding to positions 2–5 of the rotary switch. The height of pivot point 571 determines in part the "firing" position of the pitching arm 550, i.e., the point at which the energy of the spring is transferred to the arm 550 during arm rotation. Basically, the higher the pivot point 571, relative to the base 205, the later the "firing" position of the arm 550 during its rotation and the lesser the trajectory of the ball hurled therefrom.

Figure 10:
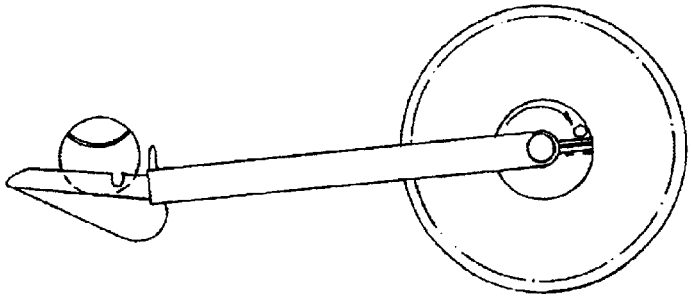
FIG. 10 is a diagrammatic view showing the position of the pitching arm in its ball pick up position upon further clockwise rotation of the wheel and pitching arm.

Upon rotation of the wheel 520 the scoop 562 on arm 550 will pass through the spaced-apart rods 264 of the ball rest so as to deposit the ball therein (FIG. 10). Subsequent rotation of wheel 520 urges the hub stop 526/flange 556 combination to an over center position, i.e., the phantom line FIG. 10 position.

Figure 11:
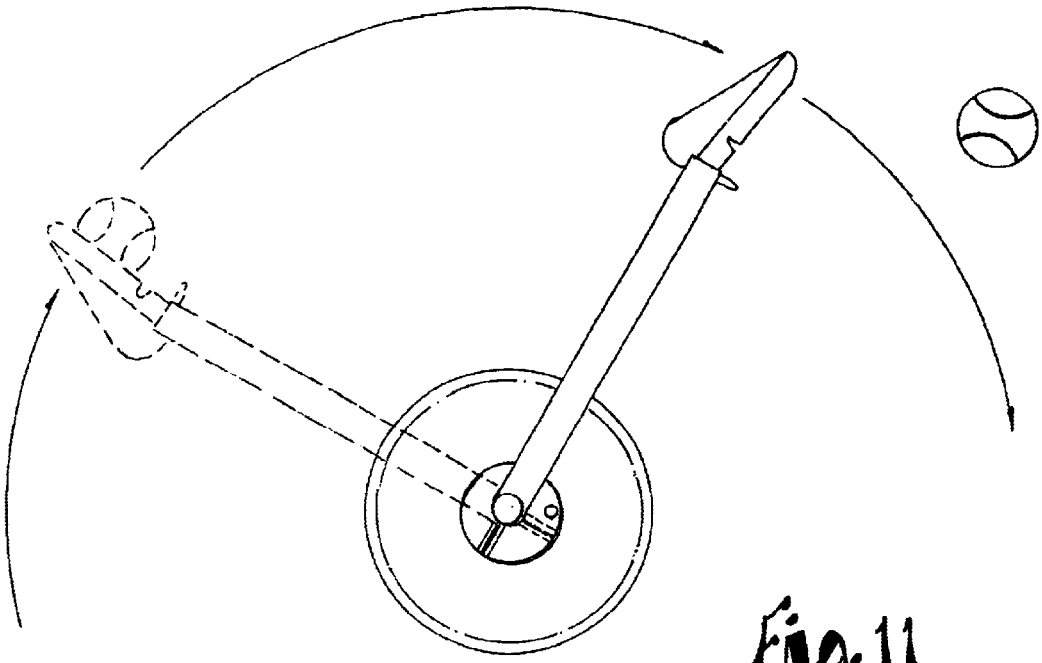
FIG. 11 is a diagrammatic view of the pitching arm showing in phantom lines the pitching arm upon clockwise rotation to an over center position and in solid lines the pitching arm at its ball hurling position, the hub stop being free of the pitching arm bracket.

At an over center position the braking contact of the stop 524/bracket 556 combination loses its effect. Thus, the upper end 416 of flexed leaf spring 410 is free to move from its subsequently flexed position (clockwise, FIG. 7) to its previous flexed position (FIG. 5). This spring movement occurs at a point during arm rotation which transfer the energy of the flexed spring 410 to the arm 550 via the linkage arms 448, 572, 570 causing an accelerated rotation/"firing" of the arm towards a solid line ball hurling position (FIG. 11). During this movement the ball is released from the scoop 562 and through the opening in the front wall 210 of the housing. Shock absorber apparatus 700 is connected to frame and pitching arm 550 so as to dampen the movement of arm after ball release to preclude arm damage.

As above described, the pivot point height is the lowest at position 1 and the highest at position 6. The higher the pivot point the later the "firing" of the arm 550 as the path of transfer of energy from spring end 416 to arm 550, defined by the linkage arms therebetween, varies from a straight line path. Thus the lesser the trajectory. Thus, at switch position 1 the pivot point 571 is at its lowest as motor 472 operates for the least amount of time. Thus, the "firing" position of arm 550 is at its earliest point during arm rotation resulting in the greatest ball trajectory. At switch position 6 the motor 472 operates for the greatest amount of time placing the pivot point 571 at its highest relative to base. Thus, the "firing" position of arm is at its latest point during arm rotation. This results in the least ball trajectory. Accordingly, at positions 2–6 successively later firing positions and lesser ball trajectories relative to position 1 result. Concurrently, the spring end 416 is being incrementally flexed from positions 1 to 6 which can also increase ball speed. Thus, the incremental decrease in ball trajectory and/or increase in spring flexion can contribute in part to the ball speed and thus the arrival time of ball after release.

After ball release the motor 510 returns the wheel 520 and arm 550 to their normal FIG. 8 position. The ball trough 262/ball rest 264 combination has deposited another ball on the ball rest. Subsequently, the motor 510 can again be user energized causing rotatable movement of the arm 550 as above described through the rest, ball pick up, over center and ball hurling positions for a subsequent ball delivery. If the ball delivery speed is too slow or fast, an appropriate selection of the six rotary switch positions will vary ball speed/ball delivery time to the user due to the changes in ball trajectory or ball speed or both.

Accordingly, it can be seen that the spring tension assembly 400 is operable so as to move the spring 410 to one of six user selectable positions corresponding to a particular degree of spring flexion which in part determines ball speed. Also, the pivot point height 571 is being regulated which regulates the arm 550 "firing" position and thus ball trajectory. Once such position has been achieved, the pitching arm assembly 500 is user energized for rotation of arm 550 through a rest position, ball pick up position and over center position. During such rotation the arm 550 is coupled to the spring 410 for further flexion of spring 410. Thus, the stored energy of the flexed spring 410 is available for delivery to the pitching arm 550. Upon the arm 550 reaching the over center position the energy of the flexed spring 410 is transferred to the arm 550 via linkage arms as positioned corresponding to rotary switch positions 1–6, causing an arm firing/accelerated rotation of the arm 550 and a ball release therefrom. Understandably the greater the spring flexion as selected by rotary switch positions 1–6 the more energy available for delivery to the arm rotation and the ball released therefrom. Also, the corresponding changes in ball trajectories can contribute to the speed in which the hurled ball reaches the user. I have found that the decreasing changes in ball trajectories at positions 1–6 cooperate with/compensate for the increasing changes in ball speeds at positions 1–6 so that the ball reaches the batter in the desired strike zone at such various switch positions.

It is to be understood that while a certain form of this invention has been illustrated and described, it is not limited thereto, except in so far as such limitations are included in the following claims and allowable equivalents thereof.

Having thus described the invention, what is claimed as new and desired to be secured by Letters Patent is:

1. An apparatus for propelling a ball, said apparatus comprising:

a frame;

a pitching arm, said pitching arm having a first end and a second end adapted for placement of a ball thereon;

means for rotatably mounting said pitching arm to said frame for movement of said second end from a first position to a subsequent ball release position;

a spring having first and second ends, said spring mounted to said frame;

means for flexing said first or second ends of said spring or both from a first spring position to a second flexed spring position chosen from a plurality of possible second spring positions;

means for coupling said flexed spring at said second position to said pitching arm during said rotation of said pitching arm towards said ball release position, a release of said flexed spring from said second position transferred to said pitching arm for rotating said pitching arm towards said ball release position and hurling a ball placed on said second arm end therefrom, a speed of the hurled ball determined in part by a degree of spring flexion corresponding to said selected second flexed spring position.

2. The apparatus as claimed in claim 1 wherein said coupling means includes means for changing a trajectory of the hurled ball.

3. The apparatus as claimed in claim 2 wherein the trajectory determines in part the speed of the hurled ball as presented to a batter.

4. The apparatus as claimed in claim 1 wherein said rotatable mounting means comprises:

a wheel rotatably mounted about an axis extending through said frame;

means for rotating said wheel;

a lug on said wheel, said first end of said pitching arm presenting structure adjacent said lug;

said rotating wheel urging said lug into contact against said first end structure of said pitching arm, wherein said contact concurrently rotates said pitching arm with said wheel towards said ball release position.

5. The apparatus as claimed in claim 4 wherein said coupling means comprises:

means for linking said first arm end to said spring at said contact whereby a rotation of said first arm end operates said linking means and flexes said spring linked thereto.

6. The apparatus as claimed in claim 1 wherein said spring flexing means comprises:

a first spring linkage assembly connected to said first end of said spring and mounted in movement with an associated axis extending through said frame;

a second spring linkage assembly connected to said second end of said spring and mounted in movement with an associated axis extending through said frame;

first means for rotating said axis associated with said first spring linkage assembly, said rotation causing a flexion of said first spring end connected to said first spring linkage assembly;

second means for rotating said axis associated with said second spring linkage, said rotation causing a flexion of said second spring end connected to said second spring linkage assembly;

means for regulating said first and second axis rotating means, wherein to regulate the flexion of said first end or second ends of said spring or both.

7. The apparatus as claimed in claim 6 wherein said first rotating means comprises:

a first shaft defining said associated axis of said first spring linkage assembly;

a first wheel rotatable with said first shaft;

an electric motor in selectable communication with a power source;

a chain driven by said motor and coupled to said first wheel to rotate said first wheel and said first shaft;

means for regulating communication of said motor with said power source, whereby to rotate said first wheel for movement of said first spring linkage assembly upon operation of said motor, a degree of rotation of said first wheel and said first shaft corresponding to a degree of movement of said first spring linkage assembly and said flexion of said first spring end connected thereto.

8. The apparatus as claimed in claim 7 wherein said second rotating means comprises:

a second shaft defining said associated axis of said second spring linkage assembly;

a second wheel rotatable with said second shaft, said chain coupling said second wheel to said motor to rotate said second wheel and said second shaft;

said means for regulating the communication of said motor with said power source rotating said second wheel for movement of said second spring linkage assembly upon operation of said motor, a degree of rotation of said second wheel and said second shaft corresponding to a degree of said flexion of said spring end connected to said second spring linkage assembly.

9. The apparatus as claimed in claim 8 wherein said regulating means comprises:

an electrical circuit with said power source and motor therein;

switch means for controlling said circuit including a plurality of user selectable switches, a user selectable closure of one of said switches closing said circuit for communicating said power source with said motor;

a motor shaft rotatable by operation of said motor and positioned adjacent said switches;

a plurality of lugs about said motor shaft in a one-to-one relationship with each of said switches, a contact of a lug with said one closed switch opening said one switch for ceasing communication of said motor with said power source, said lugs positioned about said motor shaft in a manner wherein a contact of each of said lugs with said one related closed switch results in a different time period of motor operation and rotation of said motor shaft.

10. The apparatus as claimed in claim 9 wherein said lugs are placed about said motor shaft wherein a rotation of said motor shaft causing each said lug to contact said related switch at a different position of rotation of said motor shaft.

11. The apparatus as claimed in claim 6 wherein said second rotating means comprises:

a second shaft defining said associated axis of said second spring linkage assembly;

a second wheel rotatable with said second shaft;

an electric motor in selectable communication with a power source;

a chain driven by said motor and coupled to said second wheel to rotate said second wheel and said second shaft;

means for regulating communication of said motor with said power source, whereby to rotate said second wheel for movement of said second linkage assembly upon operation of said motor, a degree of rotation of said second wheel and said second shaft corresponding to a degree of movement of said second linkage assembly and said flexion of said second spring end connected thereto.

12. The apparatus as claimed in claim 1 further comprising:

a ball rest attached to said frame;

a scoop attached to said second end of said pitching arm;

said arm rotation from said first arm position urging said scoop into movement past said ball rest for deposit of a ball on said ball rest into said scoop prior to said arm reaching said ball release position.

13. The apparatus as claimed in claim 1 wherein said spring comprises a leaf spring.

14. An apparatus for hurling a ball, said apparatus comprising:

a frame;

a pitching arm attached to said frame, said pitching arm adapted for placement of a ball thereon;

means for moving said pitching arm between a first rest position and a second ball hurling position;

a spring assembly including a spring thereon, said spring having a first position and a second flexed position displaced from said first position for storage of potential energy therein;

means for moving said spring to a selectable second flexed position of a plurality of possible second flexed spring positions, whereby to vary the degree of flexion of said spring;

means for transferring a potential energy of said spring at said second position to said pitching arm during said movement of said pitching arm, said transferred energy moving said pitching arm to said ball hurling position for release of a ball on the pitching arm therefrom, a speed of the released ball corresponding in part to the degree of flexion of said spring at said second spring position.

15. The apparatus as claimed in claim 14 wherein said transfer means includes means for changing a trajectory of the released ball, said trajectory in part affecting the speed of the ball presented to the user.

16. The apparatus as claimed in claim 14 wherein said pitching arm moving means comprises:

a wheel having a shaft defining a horizontal axis;

means for rotating said wheel;

means for coupling movement of said pitching arm to rotation of said wheel for rotation of said arm between said first rest and second ball hurling positions.

17. The apparatus as claimed in claim 14 wherein said spring moving means comprises:

a motor energized by a power source;

at least one wheel attached to said frame and rotatable by said energized motor;

linkage means connected to said at least one wheel and said spring, a rotation of said at least one wheel moving of said linkage means in a manner to flex said spring;

means for selectably rotating said wheel from a first wheel position to a second wheel position selectable from a plurality of possible second wheel positions, said selected second wheel position effecting a degree of movement of said linkage means and a flexion of said spring connected thereto.

18. The apparatus as claimed in claim 17 wherein said spring is a leaf spring comprising first and second ends, said linkage means connected to said first or second ends of said leaf spring or both, a movement of said linkage means flexing said spring at said first and second ends thereof or both.

19. The apparatus as claimed in claim 17 wherein said selectable rotating means comprises:

means for energizing said motor by said power source for a user selectable time period chosen from a plurality of possible time periods, said length of said time of motor energization presenting a selectable time of movement of said linkage means and a degree of flexion of said spring attached thereto.

20. The apparatus as claimed in claim 14 wherein said transfer means further includes:

means for further flexing said spring from said second spring position during said movement of said pitching arm from said first position and releasing said flexion of said spring, said means transferring said energy of said released spring to said arm.

21. An apparatus for hurling a ball, said apparatus comprising:

a frame;

a pitching arm rotatably attached to said frame, said pitching arm having a first end and a second end adapted for placement of a ball thereon;

means for rotating said pitching arm between a first rest position and a second ball hurling position;

a spring mounted to said frame, a flexion of said spring from said first position to a second position resulting in a storage of potential energy therein;

means for moving said spring to a second flexed position user selectable from a plurality of second flexed positions, whereby to vary the degree of potential energy stored in said spring;

means for initially coupling said spring at said second flexed position to said pitching arm during said pitching arm rotation and subsequently releasing the potential energy of said coupled spring to said pitching arm during a subsequent arm rotation, said released energy further rotating said pitching arm to said hurling position for release of a ball on said second arm end therefrom, a speed of rotation of said arm regulated in part by to a degree of flexion of said spring at said second spring flexed .,position.

22. The apparatus as claimed in claim 21 wherein said coupling means further regulates a trajectory of the ball released from said second arm end.

23. The apparatus as claimed in claim 21 further comprising:

a ball rest mounted to said frame for placement of a ball thereon, said ball rest in a path of rotation of said arm second end, wherein the ball is deposited on said second arm and during said arm rotation.

* * * * *

UNITED STATES PATENT AND TRADEMARK OFFICE

CERTIFICATE OF CORRECTION

PATENT NO. : 6,715,478 B1
DATED : April 6, 2004
INVENTOR(S) : Steven R. Tanner

It is certified that error appears in the above-identified patent and that said Letters Patent is hereby corrected as shown below:

Column 10,
Line 38, delete “.,position” and substitute -- position --.

Signed and Sealed this

Twentieth Day of July, 2004

JON W. DUDAS
*Acting Director of the United States Patent and Trademark Office*